US009811015B2

(12) United States Patent
Urabe et al.

(10) Patent No.: US 9,811,015 B2
(45) Date of Patent: Nov. 7, 2017

(54) TONER PARTICLE, ELECTROPHOTOGRAPHIC TONER, DEVELOPING AGENT, TONER CARTRIDGE AND IMAGE FORMING APPARATUS, AND MANUFACTURE METHOD OF TONER PARTICLE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Takashi Urabe, Shizuoka (JP); Taishi Takano, Shizuoka (JP); Junichi Ishikawa, Shizuoka (JP); Maiko Yoshida, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/948,580

(22) Filed: Nov. 23, 2015

(65) Prior Publication Data

US 2017/0146918 A1 May 25, 2017

(51) Int. Cl.
*G03G 9/08* (2006.01)
*G03G 9/093* (2006.01)

(52) U.S. Cl.
CPC ..... *G03G 9/093* (2013.01); *G03G 9/0821* (2013.01); *G03G 9/09392* (2013.01)

(58) Field of Classification Search
CPC ... G03G 9/093; G03G 9/09392; G03G 9/0821
USPC ..... 430/110.2
See application file for complete search history.

(56) References Cited

U.S. PATENT DOCUMENTS

| | | | | |
|---|---|---|---|---|
| 5,928,830 | A * | 7/1999 | Cheng | G03G 9/09321 430/137.12 |
| 6,136,490 | A * | 10/2000 | Ogawa | G03G 9/09392 430/109.3 |
| 9,170,510 | B2 | 10/2015 | Araki | |
| 2007/0269733 | A1* | 11/2007 | Ohta et al. | G03G 9/0821 430/125.3 |
| 2008/0003512 | A1 | 1/2008 | Kobayashi et al. | |
| 2009/0053631 | A1 | 2/2009 | Matsumura | |

FOREIGN PATENT DOCUMENTS

| | | |
|---|---|---|
| EP | 1923746 A1 | 5/2008 |
| JP | 2009-216914 | 9/2009 |

OTHER PUBLICATIONS

Extended European Search Report for European Patent Application No. 16185602.6 mailed on Apr. 20, 2017, 7 Pages.

* cited by examiner

*Primary Examiner* — Mark A Chapman
(74) *Attorney, Agent, or Firm* — Amin, Turocy & Watson LLP

(57) ABSTRACT

In accordance with an embodiment, a toner particle comprises two or more glass transition temperatures. Wherein, a first glass transition temperature is within a range from 5 degrees centigrade to 20 degrees centigrade and a second glass transition temperature is within a range from 50 degrees centigrade to 65 degrees centigrade.

18 Claims, 2 Drawing Sheets

TONER PARTICLE, ELECTROPHOTOGRAPHIC TONER, DEVELOPING AGENT, TONER CARTRIDGE AND IMAGE FORMING APPARATUS, AND MANUFACTURE METHOD OF TONER PARTICLE

FIELD

Embodiments described herein relate generally to a toner particle, an electrophotographic toner, a developing agent, a toner cartridge and an image forming apparatus, and a manufacture method of the toner particle.

BACKGROUND

Conventionally, in order to reduce energy required for fixing a toner, a toner with excellent low temperature fixing property is developed. To improve the low temperature fixing property of the toner, it is necessary to lower a glass transition temperature (Tg) of a binder resin in the toner. However, if the glass transition temperature of the binder resin is lowered, preservation and storage property of the toner is deteriorated. Thus, if practicality of the toner is considered, the glass transition temperature can only be lowered to about 50 degrees centigrade.

A toner particle with a capsule structure (core-shell structure) is proposed as a module which maintains the fine preservation and storage property of the toner while the glass transition temperature of the binder resin is lowered. The capsule structure refers to a structure formed by a binder resin that has a low glass transition temperature at the inside (core) of the toner particle and has a high glass transition temperature at the outside (shell) of the toner particle.

In a fusion process where a binder resin for shell is fused into a binder resin for core, it is necessary to fully adhere the core and the shell to make the surface of the toner particle with the capsule structure uniformly smooth. However, in the fusion process, as the core and the shell are partially mixed, it is difficult to form an ideal capsule structure in the toner particle. That is, it is difficult to obtain a toner with both the low temperature fixing property and the preservation and storage property.

DETAILED DESCRIPTION

A toner particle of an embodiment is described.

The toner particle of the embodiment includes two or more glass transition temperatures. A first glass transition temperature is within the range from 5 degrees centigrade to 20 degrees centigrade. A second glass transition temperature is within the range from 50 degrees centigrade to 65 degrees centigrade.

Figure 1:
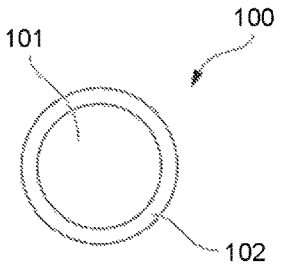
FIG. 1 is a cross-sectional view of a toner particle of an embodiment.

FIG. 1 is a cross-sectional view of the toner particle of the embodiment.

A toner particle 100 of the embodiment comprises a capsule structure consisting of a core 101 and a shell 102. The shape of the toner particle 100 can be controlled from an irregular shape to a spherical shape. The shell 102 is formed by covering the core 101.

An average particle diameter of the toner particle 100 is 3~9 μm, and more preferably 4~8 μm. If the average particle diameter is within this range, developing and transfer of a toner are easily controlled. The average particle diameter of the core 101 is about 80%~95% of the average particle diameter of the toner particle 100, and more preferably 85%~90% thereof. The thickness of the shell 102 is about 5%~20% of the average particle diameter of the toner particle 100, and more preferably 10%~15% thereof.

The core 101 is schematically constituted by a binder resin for core, a coloring agent and a wax described later. The glass transition temperature of the core 101 is within the range from 5 degrees centigrade to 20 degrees centigrade, and more preferably from 10 degrees centigrade to 15 degrees centigrade. The glass transition temperature of the core 101 mainly derives from the binder resin for core. If the glass transition temperature of the core 101 is within the range of foregoing numerical values, a lower limit temperature (lowest fixing temperature) capable of fixing the toner particle 100 becomes low. As a result, the low temperature fixing property of the toner particle 100 is improved.

The lowest fixing temperature of the toner particle 100, from the point of view of low-power fixing, is maintained preferably as low as possible, and is desired to be below 120 degrees centigrade.

The shell 102 is schematically constituted by a binder resin for shell described later. The glass transition temperature of the shell 102 is within the range from 50 degrees centigrade to 65 degrees centigrade, and more preferably from 55 degrees centigrade to 60 degrees centigrade. The glass transition temperature of the shell 102 mainly derives from the binder resin for shell. If the glass transition temperature of the shell 102 is within the range of foregoing numerical values, a storage upper limit temperature (a temperature for maintaining liquidity of the toner particle without solidifying it) of the toner particle 100 rises, and the reservation and storage property of the toner particle 100 is improved.

The storage upper limit temperature is desired to be above 51 degrees centigrade in consideration of a temperature during the transportation of an electrophotographic toner containing the toner particle 100 and a temperature in an image forming apparatus.

Difference between the glass transition temperature of the core 101 and that of the shell 102 is preferably within the range from 30 degrees centigrade to 60 degrees centigrade, and more preferably within the range from 40 degrees centigrade to 50 degrees centigrade.

In the toner particle 100 of the embodiment, each glass transition temperature of the core 101 and the shell 102 is set as stated above, and meanwhile both an excellent low temperature fixing property and a sufficient preservation and storage property can be obtained due to the existence of the forgoing temperature difference.

The toner particle 100 of the embodiment is schematically constituted by a binder resin, a coloring agent and a wax.

Hereinafter, the binder resin is described.

The binder resin, which is the main component of the toner particle of the embodiment, has a function of enabling the toner particle to be fixed on a paper or a film-shaped base material such as a plastic film. The binder resin is used as the binder resin for core and the binder resin for shell. A monomer constituting the binder resin for core may be identical to or different from a monomer constituting the binder resin for shell.

The glass transition temperature of the binder resin for core is within the range from 0 degree centigrade to 20 degrees centigrade, and more preferably from 5 degrees centigrade to 15 degrees centigrade. The glass transition temperature of the binder resin for shell is within the range from 55 degrees centigrade to 75 degrees centigrade, and more preferably from 60 degrees centigrade to 70 degrees centigrade. The binder resin for core and the binder resin for shell which have different glass transition temperatures are used together to obtain a toner particle 100 that has two or more glass transition temperatures in which a first glass transition temperature is within the range from 5 degrees centigrade to 20 degrees centigrade and a second glass transition temperature is within the range from 50 degrees centigrade to 65 degrees centigrade.

No specific limitations are given to the binder resin and a well-known resin material can be used. As the binder resin, polyester resin, polystyrene resin, polyurethane resin and epoxy resin are exemplified. Even among these binder resins, the polyester resin is preferred due to the excellence in the low temperature fixing property. As raw material monomer of the polyester resin, ≥2 valent alcohol component and ≥2 valent carboxylic acid component (e.g. carboxylic acid, carboxylic acid anhydride and carboxylic acid ester) are used.

As a divalent alcohol component, alkylene oxide adducts of bisphenol A such as polyoxypropylene (2.2)-2,2-bis (4-hydroxyphenyl) propane, polyoxypropylene (3.3)-2,2-bis (4-hydroxyphenyl) propane, polyoxyethylene (2.0)-2,2-bis (4-hydroxyphenyl) propane, polyoxypropylene (2.0)-polyoxyethylene (2.0)-2,2-bis (4-hydroxyphenyl) propane, and polyoxypropylene (6)-2,2-bis (4-hydroxyphenyl) propane; and glycols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A are exemplified.

Among these components, as the divalent alcohol component, for example, alkylene oxide adducts of bisphenol A (the number of carbon atoms in the alkyl groups is 2 or 3, and the average addition mole number is from 1 to 10), ethylene glycol, propylene glycol, 1,6-hexane diol, bisphenol A, and hydrogenated bisphenol A are preferable.

As ≥3 valent alcohol component, sorbitol, 1,2,3,6-hexanetetrol, 1,4-sorbitan, pentaerythritol, dipentaerythritol, tripentaerythritol, 1,2,4-butanetriol, 1,2,5-pentane triol, glycerol, 2-methylpropanetriol, 2-methyl-1,2,4-butanetriol, trimethylolethane, trimethylolpropane, and 1,3,5-trihydroxy methyl benzene are exemplified.

Among these components, as valent alcohol component, sorbitol, 1,4-sorbitan, pentaerythritol, glycerol and trimethylol propane are preferably exemplified.

One kind of ≥2 valent alcohol component may be used singly; alternatively, more than or equal to two kinds of ≥2 valent alcohol components are combined to be used.

As divalent carboxylic acid component, maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acid such as N-dodecenyl succinic acid, alkyl succinic acid such as N-dodecyl succinic acid or their acid anhydrides, or their alkyl esters are exemplified.

Even among these acids, as divalent carboxylic acid component, for example, maleic acid, fumaric acid, terephthalic acid and alkenyl succinic acid (the number of carbon atoms in the alkenyl group is 2 to 20) are preferable.

As ≥3 valent carboxylic acid component, 1,2,4-benzenetricarboxylic acid (trimellitic acid), 2,5,7-naphthalene tricarboxylic acid, 1,2,4-naphthalene tricarboxylic acid, 1,2,4-butane tricarboxylic acid, 1,2,5-hexane tricarboxylic acid, 1,3-carboxyl-2-methyl-2-methylene carboxy propane, 1,2,4-cyclohexane tricarboxylic acid, tetra (methylene carboxyl) methane, 1,2,7,8-octane tetracarboxylic acid, pyromellitic acid, Empol trimer acid, or their acid anhydrides or their alkyl esters are exemplified.

Even among these acids, as ≥3 valent carboxylic acid component, for example, 1,2,4-benzenetricarboxylic acid (trimellitic acid), and acid anhydride thereof and alkyl ester (the number of carbon atoms in the alkyl group is 1 to 12) are preferable.

One kind of ≥2 valent carboxylic acid component may be used singly; alternatively, more than or equal to two kinds of ≥2 valent carboxylic acid components may be combined to be used.

In the condensation polymerization process of the foregoing valent alcohol component and the ≥2 valent carboxylic acid component, esterification catalyst is used to promote chemical reaction. As esterification catalyst, dibutyltin oxide is exemplified.

One kind of binder resin may be used singly; alternatively, more than or equal to two kinds of binder resins may be combined to be used.

Content of the binder resin is preferably 50~95 mass %, more preferably 60~95 mass % and most preferably 65~90 mass % with respect to the total amount of the toner particles 100.

If the content of the binder resin is greater than the lower limit value of the forgoing range, the fixing property and toughness of image are guaranteed easily. On the other hand, if the content of the binder resin is smaller than the upper limit value of the forgoing range, the fixing property is guaranteed easily, and toner scattering is difficult to occur.

Hereinafter, a coloring agent is described.

Pigments and dyes are exemplified as the coloring agent used in the embodiment. Any one of organic pigment, inorganic pigment, organic dye and inorganic dye may be used.

As pigments, black pigment, yellow pigment, magenta pigment and cyan pigment are exemplified. Carbon black is exemplified as the black pigment. Acetylene black, furnace black, thermal black, channel black, and Ketjen Black are exemplified as the carbon black.

As yellow pigment, magenta pigment and cyan pigment, fast yellow G, benzidine yellow, India Fast Orange, Irgazin red, naphthol azo, carmine FB, permanent bordeaux FRR, pigment orange R, lithol red 2G, lake red C, rhodamine FB, rhodamine B lake, phthalocyanine blue, pigment blue, brilliant green B, phthalocyanine green, and quinacridone are exemplified.

As a preferred example of the yellow pigment, C. I. pigment yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183 and 185; and C. I. vat yellow 1, 3 and 20 are exemplified. One kind of yellow pigment may be used singly; alternatively, more than or equal to two kinds of yellow pigments may be combined to be used.

As a preferred example of the magenta pigment, C. I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209 and 238; C. I. pigment violet 19; and C. I. vat red 1, 2, 10, 13, 15, 23, 29 and 35 are exemplified. One kind of magenta pigment may be used singly; alternatively, more than or equal to two kinds of magenta pigments may be combined to be used.

As a preferred example of the cyan pigment, C. I. pigment blue 2, 3, 15, 16 and 17; C. I. vat blue 6; and C. I. acid blue 45 are exemplified. One kind of cyan pigment may be used singly; alternatively, more than or equal to two kinds of cyan pigments may be combined to be used.

One kind of coloring agent may be used singly; alternatively, more than or equal to two kinds of coloring agents may be combined to be used.

Content ratio of the coloring agent is preferably 1~10 mass %, and more preferably 2~8 mass % with respect to the total amount of the toner particles.

Hereinafter, a wax is described.

The wax has a function of improving the fixing property of the electrophotographic toner of the embodiment.

As a wax, aliphatic hydrocarbon-based wax such as low molecular weight polyethylene, low molecular weight polypropylene, polyolefin copolymer, polyolefin wax, microcrystalline wax, paraffin wax, Fischer-Tropsch wax and the like; oxide of aliphatic hydrocarbon-based wax such as oxidized polyethylene wax, or their block copolymer; vegetable wax such as candelilla wax, carnauba wax, Japan wax, jojoba wax, rice wax and the like; animal wax such as beeswax, lanolin, spermaceti and the like; mineral wax such as ozokerite, ceresin, petrolatum and the like; waxes taking fatty acid ester such as montanic acid ester wax and castor wax as main components; and waxes deoxidizing a part or all of fatty acid ester such as deoxidized carnauba wax are exemplified.

As other waxes, saturated straight chain fatty acid such as palmitic acid, stearic acid, montanic acid or long-chain alkyl carboxylic acid having even longer-chain alkyl group and the like; unsaturated fatty acid such as brassidic acid, eleostearic acid and parinaric acid and the like; saturated alcohol such as stearyl alcohol, eicosyl alcohol, behenyl alcohol, carnaubyl alcohol, glyceryl alcohol, melissyl alcohol, or long-chain alkyl alcohol having even longer-chain alkyl group; polyhydric alcohol such as sorbitol; fatty acid amide such as linoleic acid amide, oleic acid amide, or lauric acid amide; saturated fatty acid bisamide such as methylene bis stearic acid amide, ethylene capric acid amide, ethylene bis lauric acid amide, or hexamethylene bis stearic acid amide; unsaturated fatty acid amides such as ethylene bis oleic acid amide, hexamethylene bis oleic acid amide, N,N'-dioleoyladipic acid amide, or N,N'-dioleoylsebacic acid amide; aromatic bisamide such as M-xylene-bis-stearic acid amide, N,N'-distearyl isophthalic acid amide and the like; fatty acid metal salt (generally, a substance referred to as metal soap) such as calcium stearate, calcium laurate, zinc stearate, or magnesium stearate; waxes grafted to aliphatic hydrocarbon-based wax using styrene or vinyl monomer such as acrylic acid; partial ester compounds of polyhydric alcohols and fatty acids such as behenic acid monoglyceride; and methyl ester compounds having hydroxy group and obtained by hydrogenating vegetable oil are exemplified.

Even among the foregoing waxes, as it is intended to further improve the fixing property, aliphatic hydrocarbon-based wax is preferred.

One kind of wax may be used singly; alternatively, more than or equal to two kinds of waxes may be combined to be used.

Content ratio of the wax is preferably 2~20 mass %, and more preferably 4~12 mass % with respect to the total amount of the toner particles.

If the content of the wax is greater than the lower limit value of the forgoing range, an offset property is improved and the fixing property is guaranteed easily. On the other hand, if the content of the binder resin is within the upper limit value of the forgoing range, the filming is difficult to occur.

The toner particle of the embodiment, in addition to the binder resin, the coloring agent and the wax, may contain another compound (random compound) as needed. A charge control agent and a cross-linkable material are exemplified as the random compound.

The charge control agent may be blended in the toner particle of the embodiment to control frictional charging charge quantity. As the charge control agent, metal-containing azo compound and metal-containing salicylic acid derivative compound are exemplified.

Complex or complex salt of metal and azo compound or their mixture is exemplified as the metal-containing azo compound. Iron, cobalt and chromium are exemplified as metallic elements. Complex or complex salt of metal and salicylic acid derivative or their mixture is exemplified as the metal-containing salicylic acid derivative compound. Zirconium, zinc, chromium and boron are exemplified as metallic elements.

The cross-linkable material may be blended in the toner particle of the embodiment.

No specific limitations are given to the cross-linkable material as long as it is a material reacting with carboxyl group in water. As the cross-linkable material, a material having carbodiimide group (manufactured by Nisshinbo Chemical Co., Ltd., Carbodilite V-02, V-02-L2, SV-02, V-04, E-02, E-03A, and E-04) is exemplified. As other cross-linkable material, a material having oxazoline group (manufactured by Nippon Shokubai, EPOCROS WS-300, WS-500, WS-700, K-2010E, K-2020E, and K-20~30E) is exemplified.

Hereinafter, a manufacture method of a toner particle of the embodiment is described.

A chemical manufacture method not a pulverization manufacture method is used to manufacture the toner particle of the embodiment. The manufacture method of the toner particle of the embodiment includes an aggregation process in which a flocculant is added in a mixture containing a binder resin for core, a coloring agent and a wax to form a core through aggregating the mixture at a temperature higher than 20 degrees centigrade; a cooling addition process in which the core is cooled to a temperature smaller than 20 degrees centigrade and the flocculant is added in the cooled core at a temperature smaller than 20 degrees centigrade; and a fusion process in which a binder resin for shell is added in the core added with the flocculant more than twice at different temperatures to form a shell through making the binder resin for shell fused in the core.

In the aggregation process, a mixture containing a binder resin for core, a coloring agent and a wax is used. Specifically, an emulsified liquid of the binder resin for core, a dispersion liquid of the coloring agent particle and a dispersion liquid of the wax particle are mixed to be used. The content ratio of the coloring agent is preferably 2~10 pts. mass with respect to 100 pts.mass of the binder resin for core. The content ratio of the wax is preferably 2~15 pts.mass with respect to 100 pts.mass of the binder resin for core.

Further, a charge control agent may be contained in the mixture.

In the aggregation process, a flocculant is added in the mixture to form a core through aggregating the mixture. The flocculant has a function of promoting the aggregation of the binder resin, the coloring agent and the wax. The flocculant may be left inside the manufactured toner particle.

As the flocculant, metal salt such as sodium chloride, calcium chloride, calcium nitrate, barium chloride, magnesium chloride, zinc chloride, magnesium sulfate, aluminum chloride, aluminum sulfate, potassium aluminum sulfate and the like; non-metal salt such as ammonium chloride, ammonium sulfate and the like; inorganic metal salt polymer such as poly aluminum chloride, poly aluminum hydroxide, calcium polysulfide and the like; polymer coagulant such as polymethacrylic acid ester, polyacrylic acid ester, polyacrylamide, acrylamide-sodium acrylate copolymer and the like; coagulant such as polyamine, polydiallyl ammonium halide, polydiallyl dialkyl ammonium halide, melanin formaldehyde condensate, dicyandiamide and the like; alcohol such as methanol, ethanol, 1-propanol, 2-propanol, 2-methyl-2-propanol, 2-methoxyethanol, 2-ethoxyethanol, 2-butoxyethano and the like; organic solvent such as acetonitrile, 1,4-dioxane and the like; inorganic acid such as hydrochloric acid, nitric acid and the like; and organic acid such as formic acid, acetic acid and the like are exemplified.

Even in these chemicals, non-metal salt is used preferably and ammonium sulfate is used more preferably in order to enhance the effect of promoting the aggregation.

No specific limitations are given to the temperature of the mixture at the time the flocculant is added therein, as long as it is a temperature at which liquid phase of aqueous medium is maintained. After addition of the flocculant, the temperature of the mixture is adjusted to above 20 degrees centigrade, and preferably above 30 degrees centigrade. An upper limit value of the temperature of the mixture may be any temperature at which the aqueous medium is not vaporized, for example, 90 degrees centigrade. By adjusting the temperature of the mixture within the range, it is possible to promote the aggregation of the mixture and form a core with an average particle diameter of 1~5 μm.

As the aggregation of the mixture is early started, the temperature of the mixture may be adjusted within a range from 20 degrees centigrade to 90 degrees centigrade, more preferably from 30 degrees centigrade to 90 degrees centigrade before the addition of the aggregation. The addition amount of the aggregation, which is not particularly limited, for example, is preferably 20~30 pts.mass, and more preferably 22~25 pts.mass with respect to 100 pts.mass of the binder resin for core.

In the cooling addition process, first, core-containing dispersion liquid formed in the aggregation process is cooled to a temperature smaller than 20 degrees centigrade. The temperature of cooled core-containing dispersion liquid is preferably below 10 degrees centigrade, and more preferably below 5 degrees centigrade. A lower limit value of the temperature of the core-containing dispersion liquid may be any temperature at which the dispersion liquid is not frozen, for example, 1 degree centigrade.

After the core-containing dispersion liquid is cooled, the core-containing dispersion liquid is added with a flocculant while maintaining the temperature thereof. The category of the flocculant may be identical to that of the flocculant used in the aggregation process. The addition amount of the flocculant, which is not particularly limited, for example, is preferably 40~60 pts.mass, and more preferably 44~50 pts.mass with respect to 100 pts.mass of the binder resin for core.

At this stage, as the temperature of the core-containing dispersion liquid is smaller than 20 degrees centigrade, the aggregation of the core is not advanced.

In the fusion process, a binder resin for shell is added in the core-containing dispersion liquid added with the flocculant at different temperatures more than twice to form a shell through fusing the binder resin for shell into the core.

The temperature of the core-containing dispersion liquid at the first time when the binder resin for shell is added therein is preferably greater than 10 degrees centigrade and smaller than 20 degrees centigrade. If the temperature of the core-containing dispersion liquid is greater than 10 degrees centigrade, the fusion of the binder resin for shell to the core is promoted. If the temperature of the core-containing dispersion liquid is smaller than 20 degrees centigrade, the aggregation of the cores is suppressed.

The formation of the shell through the binder resin for shell can be confirmed by sampling the forgoing dispersion liquid, performing a centrifugation processing and observing whether supernatant solution is transparent or not.

The temperature of the core-containing dispersion liquid at the second time when the binder resin for shell is added is preferably higher than that of the core-containing dispersion liquid at the first time when the binder resin for shell is added. The fusion of the binder resin for shell to the core is promoted according to the rise of the temperature. At a temperature higher than that of the core-containing dispersion liquid at the first time when the binder resin for shell is added, the binder resin for shell is further fused in the core by carrying out the second addition of the binder resin for shell.

No specific limitations are given to the number of times of addition of the binder resin for shell, and the number of times may be only twice or more than three times. The temperature of the core-containing dispersion liquid at the time of the addition of the binder resin for shell is set highly along with the increase of the number of times of the addition. In the fusion process, a difference between the temperature at the time of the first addition of the binder resin for shell and that at the time of the final addition of the binder resin for shell is preferably greater than 15 degrees centigrade. If the temperature difference of greater than 15 degrees centigrade is set, the fusion of the binder resin for shell to the core is slowly promoted, and thus a stable shell having a sufficient thickness of film can be formed.

In a case in which the number of times of the addition of the binder resin for shell is twice, for example, the first addition of the binder resin for shell is carried out at a temperature greater than 10 degrees centigrade and smaller than 20 degrees centigrade, and the second addition of the binder resin for shell is carried out at a temperature range from 35 degrees centigrade to 50 degrees centigrade.

In a case in which the number of times of the addition of the binder resin for shell is three times, for example, the first addition of the binder resin for shell is carried out at a temperature greater than 10 degrees centigrade and smaller than 20 degrees centigrade, the second addition of the binder resin for shell is carried out at a temperature range from 30 degrees centigrade to 36 degrees centigrade, and the third addition of the binder resin for shell is carried out at a temperature range from 40 degrees centigrade to 50 degrees centigrade.

In the fusion process, after the final addition of the binder resin for shell, pH of the core-containing dispersion liquid is preferably adjusted to acidic side. Through the pH adjustment, both the surface of the shell and the interface between the core and the shell in the capsule structure of the toner particle can be smooth. As the pH adjustment agent, acidic compounds such as hydrochloric acid, sulfuric acid, nitric acid, acetic acid, citric acid and phosphoric acid are exemplified.

A proper range of the pH of the core-containing dispersion liquid is affected by the temperature of the core-containing dispersion liquid. For example, in a case in which the temperature of the core-containing dispersion liquid is 60 degrees centigrade, the pH of the core-containing dispersion liquid is preferably 5.3~6.1. If the pH of the core-containing dispersion liquid is smaller than 6.1, a smooth effect of the surface of the shell and the interface between the core and the shell can be efficiently realized. If the pH of the core-containing dispersion liquid is greater than 5.3, the rise of the glass transition temperature resulting from the core and the descent of the glass transition temperature resulting from the shell due to the mix of the core and the shell can be suppressed.

With the use of the aggregation process, the cooling addition process and the fusion process described above, the toner particle having a capsule structure of the embodiment can be manufactured. A cleaning process and a drying process may be appropriately performed in the manufactured toner particle. Further, through the performance of an external addition process in the toner particle, an electrophotographic toner can be manufactured.

The cleaning process is appropriately carried out with a well-known cleaning method. For example, the cleaning process is carried out by repeating cleaning and filtration using water. In the cleaning process, it is preferred to repeat the cleaning and filtration until conductivity of filtration liquid is smaller than, for example, 50 μS/cm.

In the drying process, the toner particle on which the foregoing cleaning process is performed is dried. The drying process is appropriately carried out with a well-known drying method.

In the external addition process, a toner particle group on which the foregoing drying process is performed and an external addition agent are mixed to obtain an electrophotographic toner of the embodiment. The external addition agent is blended in the toner particle group to adjust liquidity and charging property of the particle of the electrophotographic toner. An inorganic fine particle and a resin fine particle are exemplified as the external addition agent.

Silica, titania, alumina, strontium titanate and tin oxide are exemplified as inorganic substances constituting the inorganic fine particle. It is preferred to carry out a surface processing on the inorganic fine particle using a hydrophobizing agent from the point of view of improving environment stability. The particle diameter of the inorganic fine particle is preferably smaller than 1 μm.

Styrene-acrylic acid copolymer, polymethyl methacrylate and melamine resin are exemplified as resins constituting the resin fine particle. The resin fine particle has a function of improving cleanability of the particle of the electrophotographic toner. The particle diameter of the resin fine particle is preferably smaller than 1 μm.

One kind of external addition agent may be used singly; alternatively, more than or equal to two kinds of external addition agents may be combined to be used. Blending ratio of the external addition agent is preferably 0.01~10 mass % with respect to the total amount of the toner particle.

A sieving processing may be carried out after the external addition process. In this way, coarse particles or foreign substances are removed. As an apparatus capable of being used in the sieving processing, anultra sonic (manufactured by AkiraSakae Industry Co., Ltd.), gyro shifter (manufactured by Deoksugung tools Co., Ltd.), baibura sonic system (manufactured by Dalton Co., Ltd.), Sony clean (manufactured by Sintokogio, Ltd. Co., Ltd.), turbo screener (manufactured by Turbo Kogyo Co., Ltd.), micro shifter (manufactured by Makino Industry Co., Ltd.), and circular vibrating screen are exemplified.

As a mixer used at the time of the manufacture of the electrophotographic toner, a Henschel mixer (manufactured by Mitsui Mining Co., Ltd.), a super mixer (manufactured by Kawata Co., Ltd.), a conical ribbon mixer (Manufactured by Okawara Co., Ltd.), a Nauta mixer (manufactured by Hosokawa Micron Co., Ltd.), a turbulizer (manufactured by Hosokawa Micron Co., Ltd.), a cyclomix (manufactured by Hosokawa Micron Co., Ltd.), a spiral pin mixer (manufactured by Pacific Ocean Machinery & Engineering Co., Ltd.), and a lodige mixer (manufactured by Matsubo Co., Ltd.) are exemplified.

Hereinafter, a developing agent of the embodiment is described.

The developing agent of the embodiment contains the foregoing electrophotographic toner of the embodiment. The developing agent is preferably used for a non-magnetic one-component developing agent or two-component developing agent. If the electrophotographic toner of the embodiment is used in the two-component developing agent, a usable carrier is not particularly limited and can be appropriately selected by those skilled in the art.

The developing agent may contain a resin fine particle group such as styrene/acrylic copolymer, polyacrylic acid polymer and melamine polymer. As the resin fine particle group contained in the developing agent, MP-300 (average particle diameter 0.10 μM), MP-1451 (average particle diameter 0.15 μM), MP-2200 (average particle diameter 0.35 μM), MP-1000 (average particle diameter 0.40 μM), MP-2701 (average particle diameter 0.40 μM), MP-5000 (average particle diameter 0.40 μM), MP-5500 (average particle diameter 0.40 μM), and MP-4009 (average particle diameter 0.60 μM) serving as resin fine particles manufactured by Soken Chemical & Engineering Co., Ltd.; P2000 (average particle diameter 0.48 μM) serving as a resin fine particle manufactured by Nippon Paint Co., Ltd.; and epostar S (average particle diameter 0.20 μM), epostar FS (average particle diameter 0.20 μM), and epostar S6 (average particle diameter 0.40 μM) serving as resin fine particles manufactured by Nippon Shokubai Co., Ltd. are exemplified. Even among these resin fine particles, the particle diameters of the toner and the carrier are preferably MP-2200 and MP-1000 in particular from the point of the charging property and mechanical strength. One kind of the resin fine particle group may be used singly; alternatively, more than or equal to two kinds of resin fine particle groups may be combined to be used. The content of the resin fine particle group in the developing agent is about 0.01~0.36 pts.mass with respect to 100 pts.mass of the toner.

The developing agent of the embodiment, for example, is housed in an image forming apparatus such as an MFP (Multi-Function Peripheral) and used to form an image on an electrophotographic type image receiving medium. The developing agent of the embodiment is excellent in the preservation and storage property and the low temperature fixing property.

Hereinafter, a toner cartridge of the embodiment is described.

The toner cartridge of the embodiment is a container in which the foregoing electrophotographic toner of the embodiment is housed. A well-known container can be used as the container.

The image forming apparatus uses the toner cartridge of the embodiment to form an image under a lower power.

Hereinafter, the image forming apparatus of the embodiment is described with reference to the accompanying drawings.

The foregoing electrophotographic toner of the embodiment is housed in an apparatus main body of the image forming apparatus of the embodiment. A general electrophotographic apparatus can be used as the apparatus main body.

Figure 2:
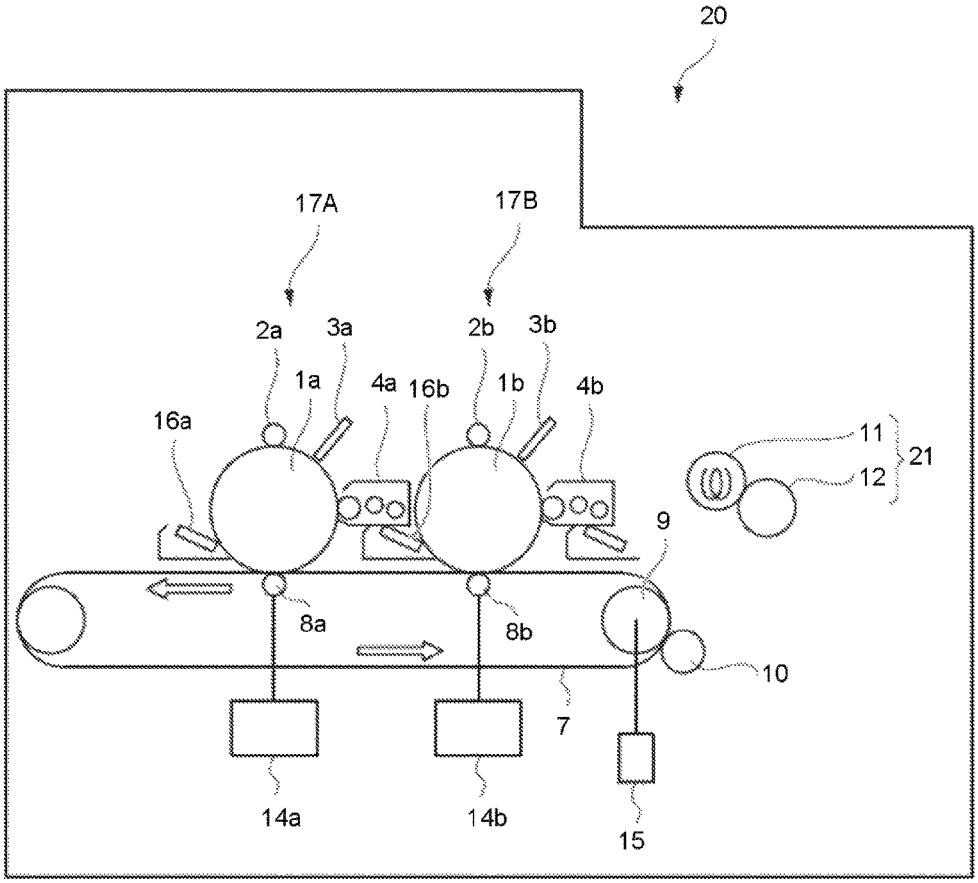
FIG. 2 is a diagram illustrating the schematic structure of an image forming apparatus of the embodiment.

FIG. 2 is a diagram illustrating the schematic structure of the image forming apparatus of the embodiment.

An image forming apparatus 20 includes an apparatus main body equipped with an intermediate transfer belt 7, a first image forming unit 17A and a second image forming unit 17B which are sequentially arranged on the intermediate transfer belt 7, and a fixing device 21 arranged at the downstream side of the first image forming unit 17A. The first image forming unit 17A is arranged at the downstream side of the second image forming unit 17B along a moving direction of the intermediate transfer belt 7, that is, along an advancing direction of an image forming process. The fixing device 21 is arranged at the downstream side of the first image forming unit 17A.

The first image forming unit 17A is provided with a photoconductive drum 1*a*, a cleaning device 16*a*, a charging device 2*a*, an exposure device 3*a* and a first developing device 4*a* which are arranged on the photoconductive drum 1*a* in sequence, and a primary transfer roller 8*a* facing the photoconductive drum 1*a* across the intermediate transfer belt 7.

The second image forming unit 17B is provided with a photoconductive drum 1*b*, a cleaning device 16*b*, a charging device 2*b*, an exposure device 3*b* and a second developing device 4*b* which are arranged on the photoconductive drum 1*b* in sequence, and a primary transfer roller 8*b* facing the photoconductive drum 1*b* across the intermediate transfer belt 7.

A developing agent containing the foregoing electrophotographic toner of the embodiment is housed in the first developing device 4*a* and the second developing device 4*b*. The toner may be supplied from a toner cartridge (not shown).

A first transfer power source 14*a* is connected with the first transfer roller 8*a*. A first transfer power source 14*b* is connected with the first transfer roller 8*b*.

A secondary transfer roller 9 is arranged to face a backup roller 10 across the intermediate transfer belt 7 at the downstream side of the first image forming unit 17A. A secondary transfer power source 15 is connected with the secondary transfer roller 9.

The fixing device 21 includes a heat roller 11 and a press roller 12 arranged to face each other.

With the use of the image forming apparatus 20, for example, an image formation processing can be carried out in the following description. First, the photoconductive drum 1*b* is uniformly charged by the charging device 2*b*. Next, an exposure processing is carried out by the exposure device 3*b* to form an electrostatic latent image. Then, a developing processing is carried out using a toner supplied from the developing device 4*b* to obtain a second toner image.

Sequentially, the photoconductive drum 1*a* is uniformly charged by the charging device 2*a*. Next, on the basis of first image information (the second toner image), an exposure processing is carried out by the exposure device 3*a* to form an electrostatic latent image. Then, a developing processing is carried out using a toner supplied from the developing device 4*a* to obtain a first toner image.

In the order of the second toner image and the first toner image, the second toner image and the first toner image are respectively transferred on the intermediate transfer belt 7 using the primary transfer rollers 8*a* and 8*b*.

An image laminated on the intermediate transfer belt 7 in the order of the second toner image and the first toner image is secondarily transferred on an image receiving medium (not shown) via the secondary transfer roller 9 and the backup roller 10. In this way, an image laminated in the order of the first toner image and the second toner image is formed on the image receiving medium.

The categories of coloring agents used in the toners housed in the developing devices 4*a* and 4*b* are randomly selected. The image forming apparatus 20 shown in FIG. 2 contains two developing devices, but may contain three or more developing devices according to the categories of the used toners.

In accordance with at least one embodiment described above, a toner particle having both an excellent low temperature fixing property and a sufficient preservation and storage property can be achieved. Through using the toner particle of the embodiment, a toner cartridge and a developing agent excellent in the preservation and storage property can be provided. Further, energy required for fixing a toner is reduced and an image forming apparatus capable of operating under a lower power can be provided.

EXAMPLES

Hereinafter, the embodiment is described more specifically with reference to examples.

Example 1

[Manufacture of Emulsion of Binder Resin for Core]

100 pts.mass of polyester resin for core (Tg: 10 degrees centigrade) and 100 pts.mass of methyl ethyl ketone are put in a flask and heated at a temperature of 40 degrees centigrade to enable resins to be dissolved in a solvent. 30 pts.mass of 10 mass % aqueous ammonia solution is dropped in the obtained solution. Further, 500 pts.mass of ion exchange water is gradually dropped in the solution and emulsion of the binder resin for core with particle diameter 130 nm is manufactured through phase inversion emulsification. After cooling, solvent is removed and then water is added so that the ratio of solid content becomes 10%. Particle diameter distribution is measured using SALD 7000 manufactured by Shimadzu Corporation.

[Manufacture of Emulsion of Binder Resin for Shell]

100 pts.mass of polyester resin for shell (Tg: 65 degrees centigrade) and 100 pts.mass of methyl ethyl ketone are put in a flask and heated at a temperature of 50 degrees centigrade to enable resins to be dissolved. 30 pts.mass of 10 mass % aqueous ammonia solution is dropped in the obtained solution. Further, 500 pts.mass of ion exchange water is gradually dropped in the solution and emulsion of the binder resin for shell with particle diameter 180 nm is manufactured through phase inversion emulsification. After cooling, solvent is removed and water is added such that the ratio of the solid content becomes 10%. Particle diameter distribution is measured using SALD 7000 manufactured by Shimadzu Corporation.

[Manufacture of Pigment Fine Particle Dispersion Liquid]

20 pts.mass of cyan pigment (manufactured by Dainichi Seika Co., Ltd., copper phthalocyanine), 1 pts.mass of anionic surfactant (manufactured by Kao Corporation, neopelex G-65) and 79 pts.mass of ion exchange water are mixed. The mixture is stirred for an hour using homogenizer (manufactured by IKA Co., Ltd., ultra tax T50) to obtain pigment fine particle dispersion liquid. Volume average particle diameter of the obtained pigment fine particle is 207 nm. Particle diameter distribution is measured using SALD 7000 manufactured by Shimadzu Corporation.

[Manufacture of Wax Fine Particle Dispersion Liquid]

Paraffin wax HNP-9 (20 pts.mass), 1.0 pts.mass of anionic surfactant (manufactured by Kao Corporation, neopelex G-65) as dispersion agent and 79 pts.mass of ion exchange water are mixed. The mixture is put in nanomizer (manufactured by Yoshida Kikai Co., Ltd., addition of a heating system in YSNM-2000AR) which sets temperature to be 120 degrees centigrade and is processed under a process pressure 150 MPa. The processing is repeated three times to obtain wax fine particle dispersion liquid. Volume average particle diameter of the obtained wax fine particle is 0.70 μm. Particle diameter distribution is measured using SALD 7000 manufactured by Shimadzu Corporation.

[Manufacture of Toner]

341 pts.mass of emulsion of binder resin for core, 13 pts.mass of pigment fine particle dispersion liquid and 17 pts.mass of wax fine particle dispersion liquid are put in a flask, and stirred for 15 minutes at 400 rpm using FULL-ZONE wing while temperature is controlled at 2 degrees centigrade. The obtained mixture is added with 80 pta.mass of 10 mass % sulfate ammonium aqueous solution as a flocculant, heated to 35 degrees centigrade and maintained for 20 minutes to obtain a coloring fine particle (core) with volume average particle diameter 2.5 μm (=aggregation process).

Next, the core-containing dispersion liquid is cooled to 2 degrees centigrade and added with 160 pts.mass of 10 mass % sulfate ammonium aqueous solution (=cooling addition process). Then, the temperature of the core-containing dispersion liquid added with the flocculant rises to 15 degrees centigrade and 40 pts.mass of emulsion of binder resin for shell drips (=fusion process). After 20 minutes elapse from the drip, sampling is carried out and centrifugation processing is carried out. Consequentially, the transparency of supernatant solution is observed to confirm that the binder resin for shell is adhered on the surface of the core.

Sequentially, the temperature of the core-containing dispersion liquid rises to 35 degrees centigrade, and 40 pts.wt. of emulsion of binder resin for shell drip at 35 degrees centigrade. Further, the temperature of the core-containing dispersion liquid rises to 45 degrees centigrade, and 120 pts.wt. of emulsion of binder resin for shell drip at 45 degrees centigrade. Then, the temperature of the core-containing dispersion liquid rises to 60 degrees centigrade, and nitric acid is added in the core-containing dispersion liquid to adjust pH to 6.1 to be maintained for 2 hours. Through the pH adjustment, the surface of the shell and the interface between the core and the shell in the capsule structure of the toner particle are smoothed.

Figure 3:
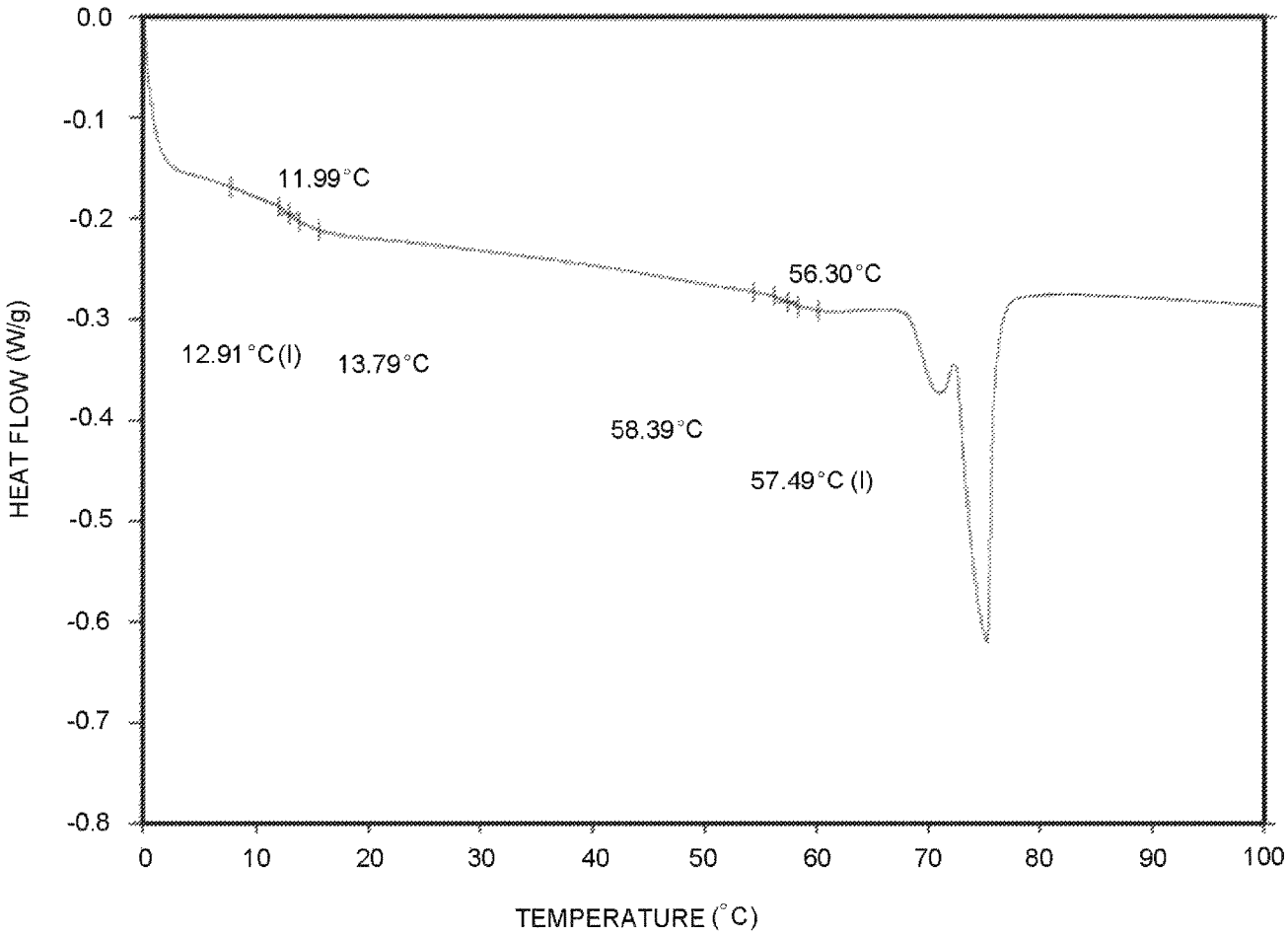
FIG. 3 is a DSC measurement result of a toner particle of a first modification.

The obtained dispersion liquid is cooled, washed by Buchner filtration and dried by a vacuum dryer until the amount of water is smaller than 1%. As a result of measurement of a volume average particle diameter of the obtained toner particle by a coulter counter (Beckman Coulter, Inc.), the volume average particle diameter is 5.5 μm. As a result of measurement of a glass transition temperature of the obtained toner particle by DSC, it is confirmed that the toner particle has two glass transition temperatures of 12 degrees centigrade and 58 degrees centigrade. FIG. 3 shows a measurement result of DSC of the toner particle of the example 1.

2 pts.mass of silica (NAX 50) to which a hydrophobic processing is carried out are added with respect to 100 pts.mass of the obtained toner particle, and an external addition processing is carried out using a Henschel mixer. In this way, an electrophotographic toner containing the toner particle is obtained.

Next, the electrophotographic toner is mixed with a ferrite carrier coated by straight silicon, and the mixture is put in an MFP e-STUDIO 5055C manufactured by TOSHIBA TEC which is remodeled in a manner of making fixing temperature changeable and a fixable lower limit temperature (lowest fixing temperature) is measured. Consequentially, the lowest fixing temperature is confirmed to be 105 degrees centigrade.

The electrophotographic toner is put in a plastic container, and a temperature at which the electrophotographic toner is solidified is inspected while the temperature is changed from 40 degrees centigrade using a thermostatic bath. As a result, the electrophotographic toner is confirmed to maintain the liquidity without being solidified until 60 degrees centigrade. As it is confirmed that aggregates are partially contained in the electrophotographic toner at 61 degrees centigrade, the storage upper limit temperature is determined to be 60 degrees centigrade.

Example 2

In the fusion process, an experiment is carried out under the same condition with the example 1 except that pH of the core-containing dispersion liquid is adjusted to 5.8 to carry out the mix of the core and the shell.

Example 3

In the fusion process, an experiment is carried out under the same condition with the example 1 except that pH of the core-containing dispersion liquid is adjusted to 5.5 to carry out the mix of the core and the shell.

Example 4

In the fusion process, an experiment is carried out under the same condition with the example 1 except that pH of the core-containing dispersion liquid is adjusted to 5.3 to carry out the mix of the core and the shell.

Example 5

In the fusion process, an experiment is carried out under the same condition with the example 1 except that 40 pts.mass of emulsion of binder resin for shell drip into the core-containing dispersion liquid at 15 degrees centigrade and then 160 pts.mass of emulsion of binder resin for shell drip at 30 degrees centigrade. After the emulsion of binder resin for shell drips at 30 degrees centigrade, the sampling is carried out and the centrifugation processing is carried out, and then it is confirmed that the supernatant solution is slightly muddy.

Comparative Example 1

In the fusion process, an experiment is carried out under the same condition with the example 1 except that 40 pts.mass of emulsion of binder resin for core drip instead of 40 pts.mass of emulsion of binder resin for shell. However, coalescence of toners occurs during the vacuum drying and the toner particle is not formed.

Comparative Example 2

In the aggregation process, an experiment is carried out under the same condition with the example 1 except that a coloring fine particle (core) is manufactured using the emulsion of binder resin for shell instead of the emulsion of binder resin for core.

Comparative Example 3

In the fusion process, an experiment is carried out under the same condition with the example 1 except that pH is adjusted to 5.0 to carry out the mix of the core and the shell.

Comparative Example 4

In the fusion process, an experiment is carried out under the same condition with the example 1 except that pH is adjusted to 5.2 to carry out the mix of the core and the shell.

Comparative Example 5

In the fusion process, an experiment is carried out under the same condition with the example 1 except that 200 pts.mass of the emulsion of the binder resin for shell is divided and does not drip more than twice at different temperatures, and the whole quantity of the emulsion of the binder resin for shell drip at 15 degrees centigrade.

After the emulsion of the binder resin for shell drips at 15 degrees centigrade, the sampling is carried out and the centrifugation processing is carried out. Consequentially, it is confirmed that the supernatant liquid is muddy in pure white. Further, the aggregates of the binder resins for shell are observed. The coalescence of the toners occurs during the drying process and the toner particle is not formed.

Comparative Example 6

In the fusion process, an experiment is carried out under the same condition with the example 1 except that 200 pts.mass of the emulsion of the binder resin for shell is divided and does not drip more than twice at different temperatures, and the whole quantity of the emulsion of the binder resin for shell drips at 30 degrees centigrade. The volume average diameter of the core particle is measured at 30 degrees centigrade and grows to 18.9 μm, and the supernatant liquid after the emulsion of the binder resin for shell drips is muddy in pure white. Further, the aggregates of the binder resins for shell are observed. The coalescence of the toners occurs during the drying process and the toner particle is not formed.

Comparative Example 7

In the fusion process, an experiment is carried out under the same condition with the example 1 except that 40 pts.mass, 40 pts.mass and 120 pts.mass of the emulsion of the binder resin for shell drip respectively at 15 degrees centigrade, 20 degrees centigrade and 25 degrees centigrade. After the emulsion of the binder resin for shell drips at 25 degrees centigrade, the sampling is carried out and the centrifugation processing is carried out. Consequentially, it is observed that the supernatant liquid is muddy in white.

Comparative Example 8

In the fusion process, after the coloring fine particle (core) is manufactured at 35 degrees centigrade, 160 pts.wt. of 10 mass % sulfate ammonium aqueous solution drip. As a result, a part of the particles of the toner particles become larger than 30 μm, and the particles cannot be measured by the Coulter counter (manufactured by Beckman Coulter, Inc.).

Evaluation results of examples 1~5 and comparative examples 1~8 are recorded in table 1.

TABLE 1

| | FIRST GLASS TRANSITION TEMPERATURE [° C.] | SECOND GLASS TRANSITION TEMPERATURE [° C.] | ADDITION START TEMPERATUR OF BINDER RESIN FOR SHELL [° C.] | ADDITION END TEMPERATURE OF BINDER RESIN FOR SHELL [° C.] | TEMPERATURE DIFFERENCE AT THE TIME OF FIRST ADDITION AND AT THE TIME OF LAST ADDITION [° C.] | STATE OF SUPERNATANT LIQUID AFTER CENTRIFUGATION | LOWEST FIXING TEMPERATURE [° C.] | STORAGE UPPER LIMIT TEMPERATURE [° C.] |
|---|---|---|---|---|---|---|---|---|
| EXAMPLE 1 | 12 | 58 | 15 | 45 | 30 | TRANSPARENT | 105 | 60 |
| EXAMPLE 2 | 14 | 56 | 15 | 45 | 30 | TRANSPARENT | 105 | 57 |
| EXAMPLE 3 | 15 | 54 | 15 | 45 | 30 | TRANSPARENT | 110 | 55 |
| EXAMPLE 4 | 17 | 51 | 15 | 45 | 30 | TRANSPARENT | 115 | 51 |
| EXAMPLE 5 | 12 | 58 | 15 | 30 | 15 | SLIGHT CLOUDINESS | 110 | 58 |
| COMPARATIVE EXAMPLE 1 | 10 | — | 15 | 45 | 30 | TRANSPARENT | NON-EVALUATION | NON-EVALUATION |
| COMPARATIVE EXAMPLE 2 | — | 62 | 15 | 45 | 30 | TRANSPARENT | 145 | 64 |
| COMPARATIVE EXAMPLE 3 | 23 | 48 | 15 | 45 | 30 | TRANSPARENT | 110 | 49 |
| COMPARATIVE EXAMPLE 4 | 20 | 49 | 15 | 45 | 30 | TRANSPARENT | 110 | 50 |

TABLE 1-continued

| | FIRST GLASS TRANSITION TEMPERATURE [° C.] | SECOND GLASS TRANSITION TEMPERATURE [° C.] | ADDITION START TEMPERATUR OF BINDER RESIN FOR SHELL [° C.] | ADDITION END TEMPERATURE OF BINDER RESIN FOR SHELL [° C.] | TEMPERATURE DIFFERENCE AT THE TIME OF FIRST ADDITION AND AT THE TIME OF LAST ADDITION [° C.] | STATE OF SUPERNATANT LIQUID AFTER CENTRIFUGATION | LOWEST FIXING TEMPERATURE [° C.] | STORAGE UPPER LIMIT TEMPERATURE [° C.] |
|---|---|---|---|---|---|---|---|---|
| COMPARATIVE EXAMPLE 5 | 10 | — | 15 | 15 | 0 | PURE WHITE | IMPOSSIBILITY OF TONER FORMATION | IMPOSSIBILITY OF TONER FORMATION |
| COMPARATIVE EXAMPLE 6 | 10 | — | 30 | 30 | 0 | PURE WHITE | IMPOSSIBILITY OF TONER FORMATION | IMPOSSIBILITY OF TONER FORMATION |
| COMPARATIVE EXAMPLE 7 | 12 | 58 | 15 | 25 | 10 | CLOUDINESS | 105 | 45 |
| COMPARATIVE EXAMPLE 8 | — | — | — | — | — | | — | — |

As recorded in table 1, in the toner particles of examples 1~5, the lowest fixing temperature is smaller than 110 degrees centigrade and the storage upper limit temperature is greater than 51 degrees centigrade. That is, it is confirmed that there is a toner particle which has both an excellent low temperature fixing property and a sufficient preservation and storage property.

On the other hand, in the comparative example 1, in the fusion process, 40 pts.mass of the binder resin for core drip instead of 40 pts.mass of the emulsion of the binder resin for shell. Thus, a capsule structure is not formed and a toner particle which includes two or more than two glass transition temperatures cannot be manufactured.

In the comparative example 2, in the aggregation process, a coloring fine particle (core) is manufactured using the emulsion of the binder resin for shell. Thus, a capsule structure is not formed and a toner particle which includes two or more than two glass transition temperatures cannot be manufactured. The lowest fixing temperature of the obtained toner particle is 145 degrees centigrade higher than 110 degrees centigrade.

In the comparative example 3, in the fusion process, pH is adjusted to 5.0 and the mix of the core and the shell is carried out. Thus, the obtained toner particle has two glass transition temperatures in which the first glass transition temperature is 23 degrees centigrade and the second glass transition temperature is 48 degrees centigrade. The storage upper limit temperature of the obtained toner particle is 49 degrees centigrade lower than 51 degrees centigrade.

In the comparative example 4, in the fusion process, pH is adjusted to 5.2 and the mix of the core and the shell is carried out. Thus, the obtained toner particle has two glass transition temperatures in which the second glass transition temperature is 49 degrees centigrade. The storage upper limit temperature of the obtained toner particle is 50 degrees centigrade lower than 51 degrees centigrade.

In the comparative example 5, in the aggregation process, the whole quantity of 200 pts.mass of the emulsion of the binder resin for shell drips at 15 degrees centigrade. Thus, the capsule structure is not formed and a toner particle which includes two or more than two glass transition temperatures cannot be manufactured.

In the comparative example 6, in the aggregation process, the whole quantity of 200 pts.mass of the emulsion of the binder resin for shell drips at 30 degrees centigrade. Thus, the capsule structure is not formed and a toner particle which includes two or more than two glass transition temperatures cannot be manufactured.

In the comparative example 7, in the fusion process, the difference between the temperature at the first time when the binder resin for shell is added and the temperature at the last time when the binder resin for shell is added is 10 degrees centigrade. Thus, the obtained toner particle has two glass transition temperatures and the storage upper limit temperature of the obtained toner particle is 45 degrees centigrade lower than 51 degrees centigrade.

In the comparative example 8, the cooling addition process is not carried out. Thus, the capsule structure is not formed and a toner particle which includes two or more than two glass transition temperatures cannot be manufactured.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A toner particle, including:

two or more glass transition temperatures, wherein a first glass transition temperature for a core of the toner particle is in a first range from 5 degrees centigrade to equal to or less than 9 degrees centigrade;

a second glass transition temperature for a shell of the toner particle is in a second range from 50 degrees centigrade to 65 degrees centigrade, and a difference between the first glass transition temperature and the second glass transition temperature is within a third range from 40 degrees centigrade to 50 degrees centigrade.

2. The toner particle according to claim 1, wherein the two or more glass transition temperatures only include the first glass transition temperature and the second glass transition temperature.

3. The toner particle according to claim 1, further comprising:

a capsule structure constituted by the core and the shell.

4. The toner particle according to claim 1, further comprising:

a coloring agent and a wax.

5. An electrophotographic toner containing a toner particle according to claim 1.

6. An developing agent containing the electrophotographic toner according to claim 5.

7. A toner cartridge for housing the electrophotographic toner according to claim 5.

8. An image forming apparatus for housing the electrophotographic toner according to claim 5.

9. The toner particle according to claim 1, wherein the shell binder resin having a thickness in a range from equal to or greater than 0.4 μm to less than 1.8 μm.

10. A manufacture method of a toner particle, including:

adding a flocculant in a mixture containing a first binder resin, a coloring agent and a wax to form a core through aggregating the mixture at a first temperature of more than 20 degrees centigrade;

cooling the core to a second temperature smaller than 20 degrees centigrade and adding a flocculant in the core at a third temperature smaller than 20 degrees centigrade; and adding a second binder resin in the core added with the flocculant more than twice at different temperatures to form a shell through fusing the second binder resin for the shell in the core; wherein a first glass transition temperature of the first binder resin for the core is in a first range from 0 degree centigrade to 20 degrees centigrade;

a second glass transition temperature of the second binder resin for the shell is in a second range from 55 degree centigrade to 75 degrees centigrade, and a difference between the first glass transition temperature and the second glass transition temperature is within a third range from 40 degrees centigrade to 50 degrees centigrade.

11. The manufacture method of the toner particle according to claim 10, wherein the first binder resin and the second binder resin have identical chemical structures.

12. A manufacture method of a toner particle, including:

aggregating a first binder resin, a coloring agent, and a wax in a dispersion at a first temperature of more than 20 degrees centigrade to form a toner core;

cooling the toner core in the dispersion to a second temperature of less than 20 degrees centigrade;

adding a second binder resin in the dispersion including the toner core at a third temperature to form a shell, the third temperature having a range from more than 10 degrees centigrade to less than 20 degrees centigrade;

aggregating the toner core and the second binder resin in the dispersion; and heating the dispersion to form an aggregated particle;

fusing the aggregated particle; wherein a first glass transition temperature of the toner core is in a first range from 0 degree centigrade to 20 degrees centigrade;

a second glass transition temperature of the shell is in a second range from 55 degree centigrade to 75 degrees centigrade, and a difference between the first glass transition temperature and the second glass transition temperature is within a third range from 40 degrees centigrade to 50 degrees centigrade.

13. The manufacture method of the toner particle according to claim 12, wherein the second binder resin is added in the dispersion through a first adding of the second binder resin and a second adding of the second binder resin.

14. A manufacture method of a toner particle, according to claim 13, wherein the first adding of the second binder resin is performed at a fourth temperature, the fourth temperature being less than 20 degrees centigrade; and the second adding of the second binder resin is performed at a fifth temperature, the fourth temperature being higher than the first temperature.

15. A manufacture method of a toner particle, according to claim 13, wherein a difference between the fourth temperature and the fifth temperature is more than 15 degrees centigrade.

16. A manufacture method of a toner particle, according to claim 12, wherein the second binder resin is added in the dispersion through a first adding of the second binder resin, a second adding of the second binder resin, and a third adding of the second binder resin.

17. A manufacture method of a toner particle, according to claim 16, wherein the first adding of the second binder resin is performed at a sixth temperature, the sixth temperature being more than 10 degrees centigrade and less than 20 degrees centigrade;

the second adding of the second binder resin is performed at a seventh temperature, the seventh temperature being more than 30 degrees centigrade and less than 36 degrees centigrade; and the third adding of the second binder resin is performed at an eighth temperature, the eighth temperature being more than 40 degrees centigrade and less than 50 degrees centigrade.

18. The manufacture method of the toner particle according to claim 12, wherein the first binder resin and the second binder resin have identical chemical structures.

* * * * *